United States Patent [19]

Morwood

[11] 4,249,686

[45] Feb. 10, 1981

[54] GUN SLING

[76] Inventor: Burton S. Morwood, 2493 Braun Ct., Golden, Colo. 80401

[21] Appl. No.: 88,954

[22] Filed: Oct. 29, 1979

[51] Int. Cl.[3] ..... F41C 33/00

[52] U.S. Cl. ..... 224/150; 224/913

[58] Field of Search ..... 224/149, 150, 913; 42/90, 94

[56] References Cited

U.S. PATENT DOCUMENTS

| | | | |
|---|---|---|---|
| 1,292,875 | 1/1919 | Randall | 224/913 X |
| 2,102,964 | 12/1937 | Mossberg | 224/150 X |
| 2,884,172 | 4/1959 | Kubo | 224/913 X |
| 3,035,746 | 5/1962 | Hayes | 224/150 |
| 3,258,182 | 6/1966 | McDonald | 224/913 X |
| 3,495,770 | 2/1970 | Seltmann, Jr. et al. | 224/150 |
| 3,948,423 | 4/1976 | Hathaway | 224/150 |
| 4,182,469 | 1/1980 | Bennett | 224/150 |

*Primary Examiner*—Stephen Marcus
*Attorney, Agent, or Firm*—Richard D. Law

[57] ABSTRACT

A quick release sling for fast shouldering and firing of shoulder-held small arms, having an adjustable size loop of a strap, which loop may be passed over the shoulder and torso of a user for weapon carrying across the user's chest with the adjustable loop is attached to a D-ring on the weapon's butt. A short strap is attached to the weapon's forearm, and a short strap is rapidly releasably secured to the loop, so that upon releasing the forearm strap from the adjustable strap, the weapon's barrel is free for shouldering the weapon for use. As a safety feature, the sling, also, includes a locking device to releasably secure the short forearm strap to the adjustable size loop, thus preventing accidental release of the weapon's barrel.

10 Claims, 10 Drawing Figures

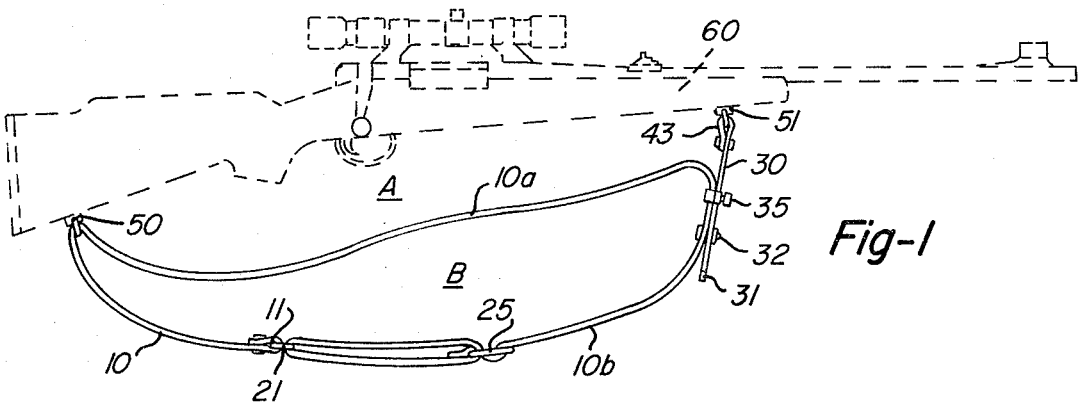
Fig-1
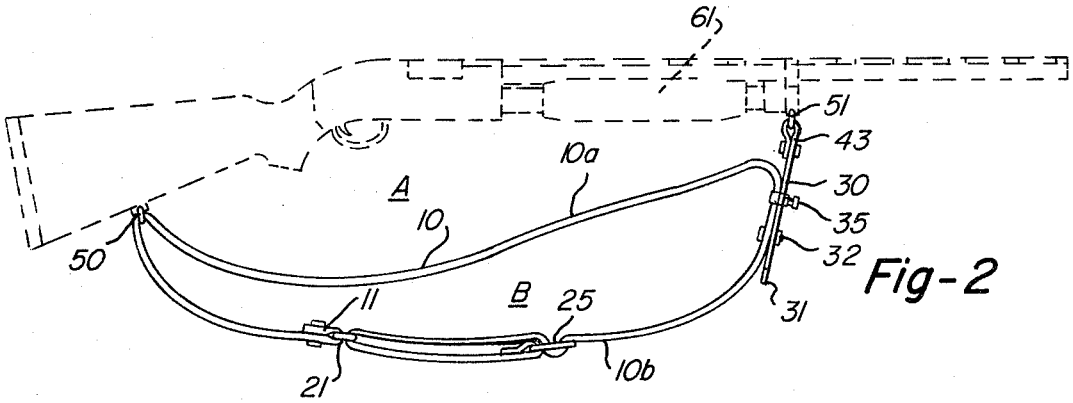
Fig-2
Fig-3
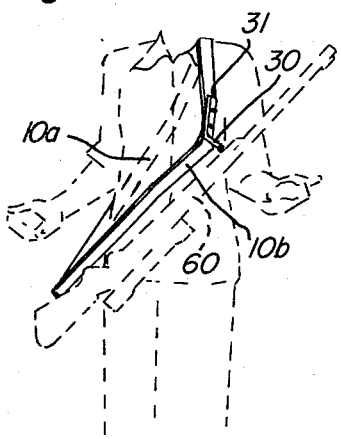
Fig-4
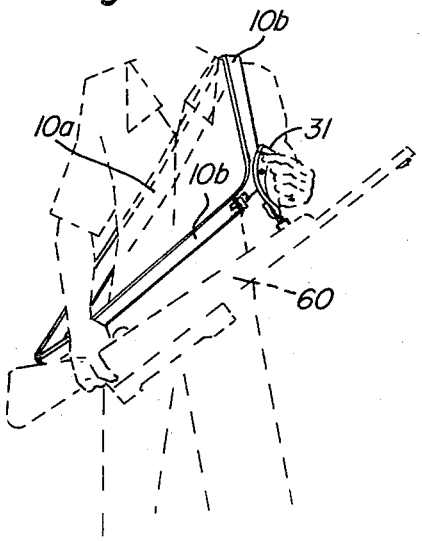

Fig-5
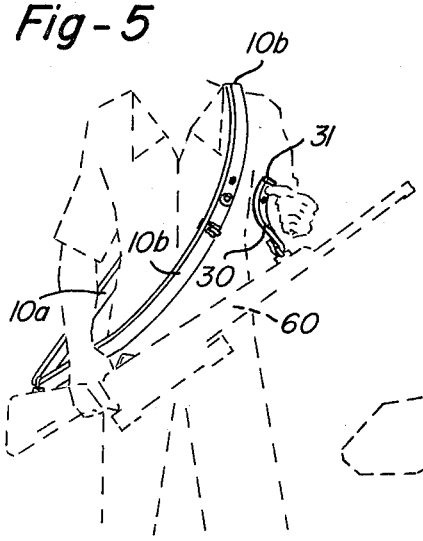
Fig-6
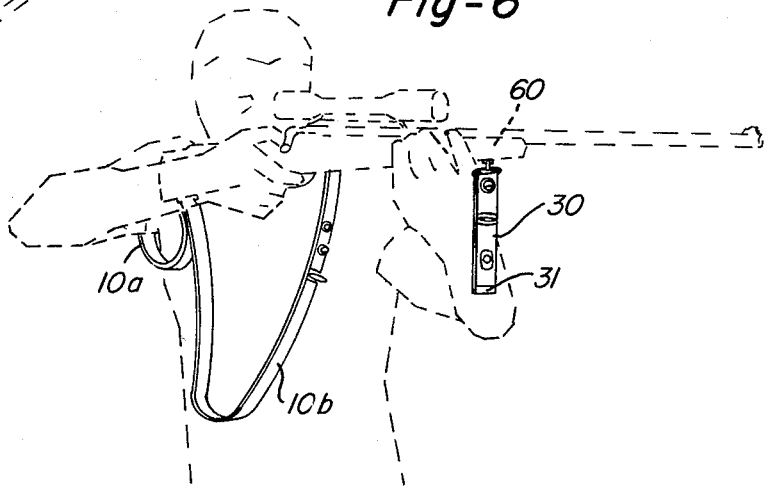
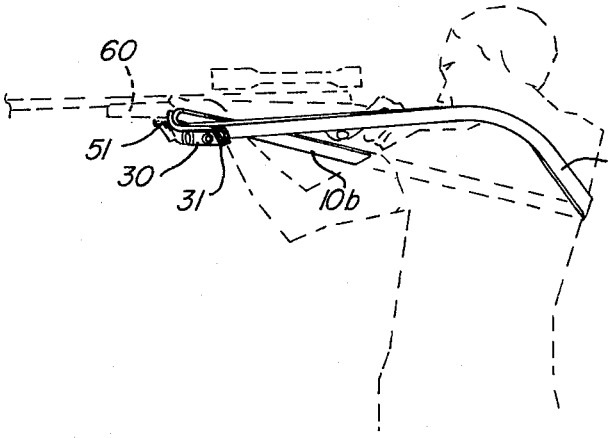
Fig-7
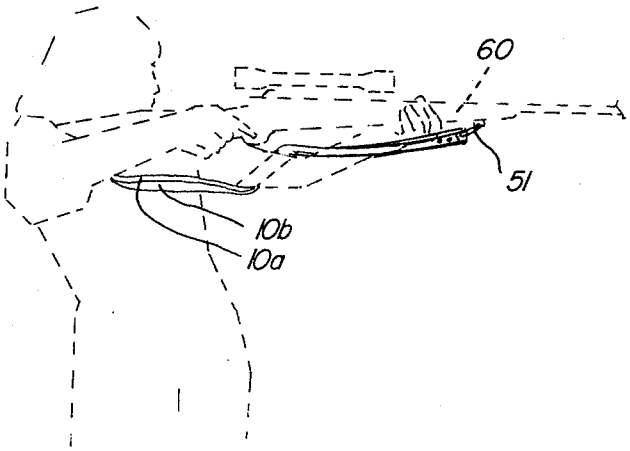
Fig-8

GUN SLING

This invention relates to gun slings for carrying small arms, in the nature of shoulder held firearms, with a rapid release of the barrel permitting the piece to be rapidly swung from carry position to fire position, while maintaining attachment of the gun butt with the sling.

PRIOR ART

Hunting of all types with shoulder held firearms has long been an activity of man. Military operations, furthermore, may include marches with rifles, etc. Long periods of hiking and carrying a rifle, shotgun or other shoulder weapons has led to the development of numerous types of harnesses, belts, slings, carrying straps and the like. Most such units ease the burden of carrying of the weapons by using over-the-shoulder straps. Most, however, do not permit a rapid change of carrying position to shoulder held fire position. Some carrying straps, conveniently called slings, are more adapted than others, to bring a piece to a firing position. For example, U.S. Pat. No. 3,948,423, issued Apr. 6, 1976 to Hathaway shows a double looped sling, the inner loop provides over-the-shoulder carrying while the outer loop provides an arm brace in firing position. The inside loop is not removed from the shoulder, and the strap of the loop must be slid over the user's clothes to bring the weapon to shoulder position.

A gunbelt for holding the gun in an across-the-chest carrying position is shown in U.S. Pat. No. 3,655,106, issued Apr. 11, 1972 to Wojcinski. The unit provides a strap for looping under an arm across the opposite shoulder. A weapon is attached an outer loop, which includes a portion mounted on a shackle slidable on the other loop strap. The unit uses a ball-pin and socket to support a barrel shackle to the over-the-shoulder strap. The ball-pin grabbing socket must be pressed toward the pin-ball to cause the two elements to release.

U.S. Pat. No. 3,495,770 issued Feb. 17, 1979 to Seltmann, Jr. uses an over-the-shoulder loop attached to a gun butt shackle and a slidable cord on the loop attached to the gun forearm.

THE PRESENT INVENTION

The present invention provides a combination of a sling for a shoulder held gun having sling D-rings, or holding rings, a carrying loop, which may be used over either shoulder, and over a shoulder and torso, providing a very rapid release of the gun barrel for gun movement from carry position to fire position at the user's shoulder. The sling is secured to the gun butt D-ring, and if the gun is dropped from the user's hands it is still held by the sling attached to the butt. The sling permits hands-off carrying across the user's chest so that the gun is very rapidly brought to fire position at the user's shoulder. The sling may, also, be used as an arm brace as with a conventional military sling if desired. Importantly, the sling of the invention may be manufactured of leather or with a synthetic polymer braided or woven strap.

OBJECTS AND ADVANTAGES OF THE INVENTION

Included among the objects and advantages of the invention is a simple, highly versatile carrying and weapon holding sling.

Another object of the invention is to provide a weapon sling for carrying and extremely rapid release from carrying position to shoulder position for snap shooting at flushed targets, for example.

Still another object of the invention is to provide a simple sling assembly attached to gun mounted D-rings for hands-free gun carrying and which may be rapidly released for quick shooting, or it may be used as an arm brace for accurate and steady sighting of the weapon.

A further object of the invention is to provide a shoulder weapon sling with a quick release for the barrel end of the weapon, permitting very rapid shouldering of the weapon for firing, and which release may be easily locked against accidental release.

Yet another object of the invention is to provide a shoulder weapon sling arranged for across-the-chest, hands-off carrying and very rapid release of the gun barrel for movement to the shouldering of the weapon, and which may be manufactured of leather or synthetic polymer, woven straps.

An additional object of the invention is to provide a simple sling for shoulder fired weapons which includes an over-the-shoulder or over-the-shoulder-and-torso loop with a quick barrel release, all of which may be manufactured with standard components.

A still further object of the invention is to provide an easily adjusted carrying or bracing sling for weapons, which may be made of web material or leather strapping for different weapons and different modes of weapons and different modes of weapon carrying.

Yet another object of the invention is to provide an easily adjusted carrying sling for weapons, which is easily adjusted for different users and/or different weapons for different modes of weapon carrying and positions.

These and other objects and advantages of the invention are readily ascertained by reference to the following description and appended drawings.

GENERAL DESCRIPTION OF THE ILLUSTRATIONS

FIG. 1 is a side elevational view of the sling of the invention, mounted on a rifle.

FIG. 2 is a side elevational view of the sling of the invention, mounted on a shotgun.

FIG. 3 is a generally schematic, perspective of a shoulder fired weapon having a sling according to the invention secured thereto, illustrating one position of hands-free carrying the weapon but in a position of very rapid use.

FIG. 4 is generally schematic, perspective of a generally first movement of the user for the release of carried weapon permitting shouldering the weapon, and FIG. 5, a general schematic, perspective, illustrates the second movement of the weapon release.

FIG. 6 is generally schematic, perspective of a further movement of a user with a shoulder weapon, having a released weapon barrel.

FIG. 7 is a generally schematic rear view of the user with a shoulder weapon, using the sling of the invention in an arm brace mode, and FIG. 8 is a front view of a user in a conventional sling usage arm brace mode, both with the barrel ring attached.

DETAILED DESCRIPTION OF THE ILLUSTRATIONS

Figures 9, 10:
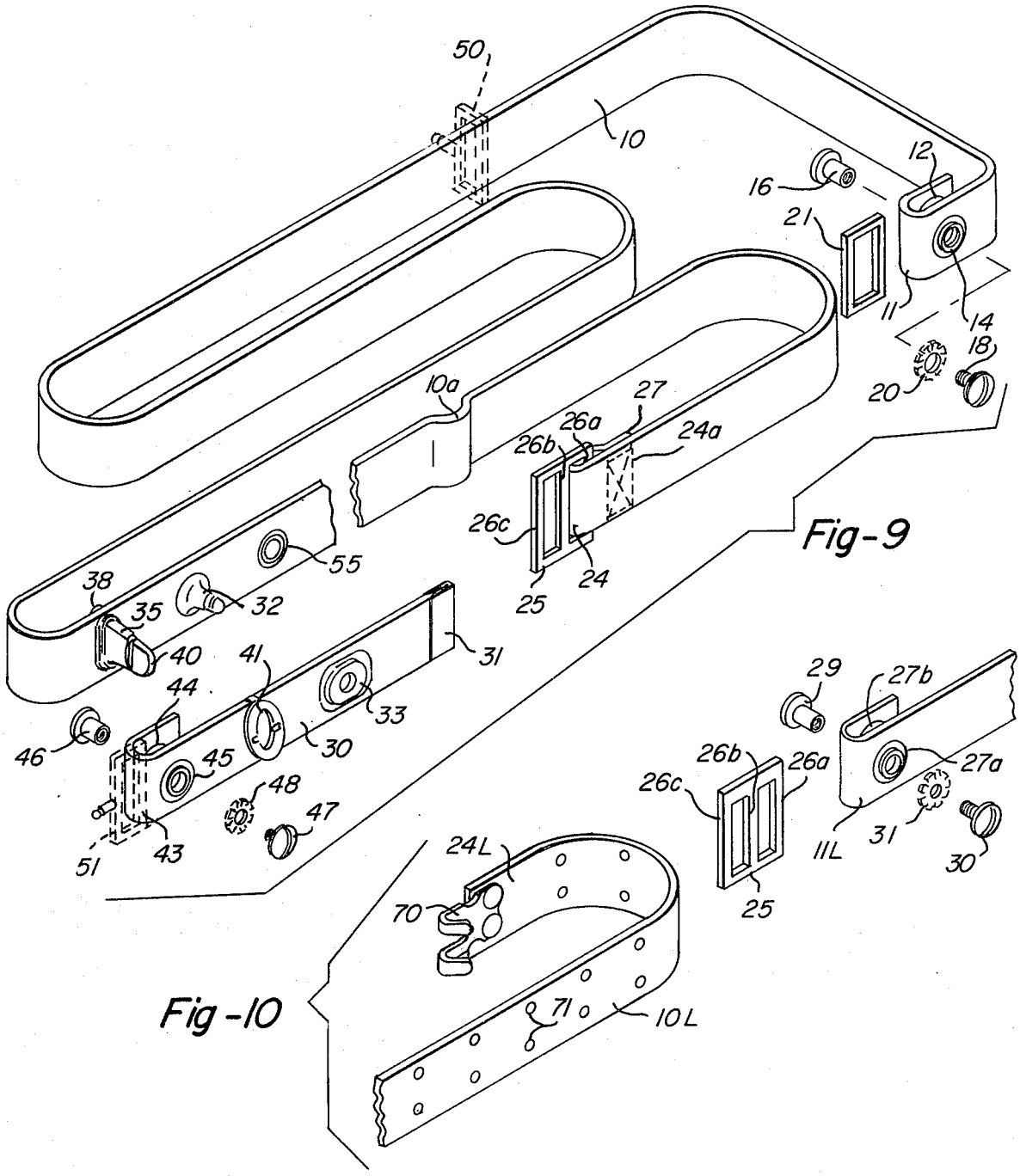
FIG. 9 is an exploded perspective view of the component parts of the sling of the invention.
FIG. 10 is a perspective view of an adjustment detail of a modified form of the invention.

The sling of the invention is intended to be used with generally standard sling attachment means on a weapon butt and the weapon forearm. Such attachment means may have D-rings on plates or swivels; and may, also, be other types of rings, strap fasteners or holders used in the gun art, therein generally referred to as sling swivels or D-rings.

The major elements of one form of the sling of the invention are shown in the exploded view of FIG. 9. In this modification the straps are made of woven or braided cord, usually nylon or other synthetic plastic cord. A major, elongated strap 10 is provided with a pair of spaced holes at one end 11 to permit the end to be reversed and formed into a loop. Releasable lock means are provided to hold the loop as a stemmed nut 16 accommodating a screw 18. The woven polymer strap is provided with grommets 12 and 14 fastened into the holes to reinforce the holes. The grommets support the stemmed nut 16 and the threadedly engaged screw 18. The screw-nut unit may be secured by lock washer 20. The loop in end 11 is secured on rectangular slip ring 21 (which in some cases may be a double rectangular ring), by the loop being formed on one of the sides of the ring. The opposite end portion 24 of the strap 10 is placed through the rectangular ring 21 (on the other long leg of the ring) so as to form an adjustable loop of the strap 10 with the end 24 reversed on itself and asjustable therealong.

The end portion 24 preferably has its end 27 sealed against unravelling, which is conventional, and is doubled back so that it may make a small loop for attachment to one led of adjusting double ring 25. The woven strap is sewn into a loop over the leg 26*a* of ring 25. The strap is reeved through the double ring so as to pass through one opening, over center leg 26*b*, and out the other opening, forming a hump 10*a* over the leg 26*b*. The strap may, therefore, be pulled through the double ring to lengthen or shorten the loop end portion of the strap between ring 21 and ring 25.

A forearm attaching strap member 30, is a short piece of the same material as the strap 10, and finished by a metal sleeve 31 or other means to prevent unravelling of woven cord and to provide a finger grip as explained below.

The strap 10 is passed through a D-ring 50, which is secured to a gun butt, as further explained below to secure the bun butt to the sling, and the strap 30 is releasably attached to the barrel or forearm D-ring.

The strap 30 is secured to a D-ring 51 (which is mounted on the forearm of weapon as explained below). The strap end portion 43 has a pair of spaced apart grommets 44 and 45 fastened in spaced apart position, and this end portion may be looped through the D-ring 51. The loop is releasably secured by a stemmed nut 46 held by a screw 47 and secured by lock washer 48.

The short strap 30 is releasably attachable to strap 10 by means of hold pin 32, releasably held in spring biased connector 33, which is a generally used fastener for military pouches, etc. This connector is easily disconnected by pulling the end 31 on strap 30. The strap 30 may, also, be locked on the strap 10 by a swivel head, flat lock pin fastener 35, secured to strap and to backing plate 38 on the opposite side of the strap. The flat lock pin fastener 35 has a swivelled, flat head 40, which when turned 90° after passing through an oval hole grommet 41 (secured in strap 30) securely locks the two straps together. Such locking connectors are used with military and other web belts, pouches, etc. The lock fastener and the connector 33 are normally used in conjunction with each other as they are quite close together. The lock fastener may be unlocked from its grommet when pin 32 is in spring biased connector grommet 33.

The discussion above is directed to woven belting, made of such polymer materials, as nylon cord, polypropylene, and other types as polyesters, etc. The strap may, also, be made of leather and of the same general configuration. A leather strap 10L, FIG. 10, has its end portion 11L turned in a reverse bend to form a loop around leg 26*a* of the double ring 25. The strap end may be releasably held in a loop by a stemmed nut 29 and screw 30 passing through spaced holes 27*a* and 27*b* in the strap. The screw-nut may be secured by lock washer 31. The opposite end 24L of the strap 10L is turned back on itself to form a loop which is passed through the double ring 25 around leg 26*c*, to provide adjustment of the loop size. Adjustment is provided by a double hooked end fitting 70, in which the double hooks are hooked into one set of a number of double holes 71 spaced along the strap, a conventional adjustment for leather belts, straps, etc.

The mounting of the unit on rifle 60 is shown in FIGS. 1, 3, 4, 5, 6, 7 and 8, and on a shotgun 61 in FIG. 2, where the strap 30 is releasably secured to the forearm D-ring, or swivel ring 51 and is releasably secured to strap 10 by fasteners 32 and 35. The strap 10 is also passed through the gun butt D-ring 50, forming a stretch 10*a* and a stretch 10*b* of the loop of strap 10, between the D-rings. This arrangement forms two carrying loops, (a) a loop A formed between the weapon and stretch 10*a* and (b) a loop B formed between stretch 10*a* and stretch 10*b*. Either loop A or loop B may be placed over a shoulder by a user putting an arm through the respective loop for conventional carrying. Loop B may be placed over a shoulder and torso, and the weapon is carried in a sloped, upright position across either the user's chest or back, FIG. 3. The across-the-chest carry is the preferred mode for very rapid release and shouldering the weapon for fire.

The sling permits the user to carry a weapon in an across-the-chest position, FIG. 3, and permits a very quick release and shouldering of the weapon. The carry position of FIG. 3 permits hands-free carrying of the piece with the weapon generally out of the way, but instantly ready to bring into firing position. In an area where pop-up targets are possible, and usually where there is little interference with brush and undergrowth, the lock pin fastener 35 is maintained in the open position. When desired to shoulder the weapon, a user grasps the gun butt, by the closest hand, FIG. 4, and with the other hand pulls on the strap end 31 of the strap 30 (when the lock fastener is in an unlocked position). End 31 rides at a very convenient location for the user's other hand. The strap 30 is quickly and easily released from strap 10, FIG. 5, leaving the weapon's barrel free. The strap 10 remains looped over the torso of the user and secured to the gun butt D-ring. The gun may now be shouldered, FIG. 6, for sighting and shooting. In the event the gun slips out of the hand or hands of the user, the butt remains attached to the loop over the torso and will not be completely released from the user. The strap 10 is maintained in its position with the loop B around the shoulder and torso but the loop is loose and may be easily turned, if necessary, on the shouldering movements of a weapon by the user.

For security, the lock pin fastener 35 may be secured in grommet 41 by turning end 40 to seat on sides of elongated hole grommet 41 on strap 30. This is a security measure when the user is engaged in vigorous activity, when passing through heavy brush, and other times when it would be detrimental to accidentally release the weapon's barrel. However, the strap 30 may be easily and quickly released by turning the end 40 of the lock pin fastener 35 and pulling on the end 31 of strap 30. The strap end is sufficiently long and has the permanent tip so that it is easily manipulated by cold fingers and gloved or mittened hands.

The sling is also usable as a sling brace for steady aiming, shown in FIGS. 7 and 8. In this case, the strap 30 is not released from the strap 10 so as to maintain the loop attachment to the forearm of the weapon. The loop, from the across-the-torso carry is elongated or shortened by pulling the strap through double ring 25 to lengthen or shorten the loop. With the loop over-the-shoulder, around the back and secured to the weapon's forearm, the user's hand and forearm are used to brace the weapon shown in FIG. 7. With the sling positioned to go from the butt swivel to under the elbow to across the arm bend and over the forearm and then under the holder's hand to the forearm swivel, as in FIG. 8, the strap is held taut to brace the gun for aiming, in conventional use.

The sling of the invention permits other carrying positions for shoulder weapons, as with a single strand sling over a shoulder with the barrel down, etc. The gun still can be quickly and easily released and swung to the shoulder position. In other carrying modes, a gun is quickly brought into usable position by releasing the forearm strap and pulling the gun to shoulder position. When the straps are formed of polymer woven material, they easily glide across most cloth materials and thus movement is not retarded. Leather which is durable, does not unduly hamper movements as it slids easily across most clothing. A snap fastener half 55 may be used for fastening a sling pad in position to rest on the user's shoulder in carrying position. The sling, also, is easily adapted to the carrying of long objects having means for attachment of the D-ring loops. Thus, bows with rings may be carried, and other athletic materials may be carried by the sling.

While the invention has been described by reference to particular embodiments, there is not intent to limit the spirit of the scope of the invention except as defined in the claims.

What is claimed is:

1. A shoulder held weapon sling for carrying and very rapid shouldering of such weapon for firing, in combination with a shoulder weapon having a butt D-ring and a barrel forearm D-ring, comprising:

a. a first strap formed into an adjustable length loop for passing over a shoulder and torso of a user, and arranged to be secured to the butt D-ring of a weapon;

b. a short, second strap secured to the forearm D-ring on a weapon leaving a free end;

c. releasable means connecting said second strap to said loop of said first strap whereby the weapon may be carried hands-off across the user's chest, and said releasable means being rapidly releasable from said first strap by pulling the free end of said second strap; and d. lock means for temporarily securing said second strap to said loop of said first strap.

2. A shoulder held weapon sling according to claim 1, wherein said first and second straps are formed of a synthetic polymer woven strap, a slip ring is releasably secured to one end of said first strap and is adjustable by having other end passed through a double rectangular adjusting ring, then through said rectangular slip ring, and then secured to said double rectangular adjusting ring.

3. A shoulder held weapon sling according to claim 1, wherein said first and second straps are formed of leather, a double ring is releasably secured to one end of said first strap and is adjustable by having the other end of the first stage passed through said double ring and reversed back on itself so as to be adjustably connected to itself.

4. A shoulder held weapon sling according to claim 1, wherein said releasable means includes a hold pin on one of said first strap and second strap, and a spring biased pin connector is secured on the other said strap, whereby said straps can be released from one another when said hold pin is pulled from said spring biased pin connector.

5. A shoulder held weapon sling according to claim 4, wherein said hold pin is secured to said first strap.

6. A shoulder held weapon sling according to claim 1, wherein said lock means includes a flat lock pin fastener with a rotatable head on one of said first and second straps and a grommet with an elongated opening on the other said strap, whereby said straps are locked together when said flat lock pin fastener is passed through said grommet and the rotatable head is turned 90°.

7. A shoulder held weapon sling according to claim 6, wherein said flat lock pin fastener is secured to said first strap.

8. A shoulder held weapon sling according to claim 1, wherein said first strap having an end secured to a butt D-ring, includes the adjusting loop of the first strap slidably secured through said D-ring.

9. A shoulder held weapon sling according to claim 1, wherein one end of said first strap includes one releasable end loop, and said second strap includes one releasable end loop.

10. A shoulder held weapon sling according to claim 1, wherein the ends of said first strap are arranged with releasable end loops, and said second strap includes one releasable end loop.

* * * * *